US008621670B2

(12) United States Patent
Hansen

(10) Patent No.: US 8,621,670 B2
(45) Date of Patent: Jan. 7, 2014

(54) PAIR OF TROUSERS

(75) Inventor: Lena Trend Hansen, Ega (DK)

(73) Assignee: HLH Invest APS, Ega (DK)

( * ) Notice: Subject to any disclaimer, the term of this patent is extended or adjusted under 35 U.S.C. 154(b) by 203 days.

(21) Appl. No.: 13/157,894

(22) Filed: Jun. 10, 2011

(65) Prior Publication Data

US 2012/0000007 A1 Jan. 5, 2012

(30) Foreign Application Priority Data

Jul. 1, 2010 (DK) ..... 2010 70310

(51) Int. Cl.
*A41F 9/02* (2006.01)

(52) U.S. Cl.
USPC ..... 2/237; 2/227

(58) Field of Classification Search
USPC ..... 2/234, 224, 231, 233, 236, 237, 243.1, 2/247
See application file for complete search history.

(56) References Cited

U.S. PATENT DOCUMENTS

| | | | | | |
|---|---|---|---|---|---|
| 1,494,767 | A | * | 5/1924 | Biehl | 2/237 |
| 1,499,647 | A | * | 7/1924 | Emsley | 2/236 |
| 1,831,930 | A | * | 11/1931 | Speh | 2/227 |
| 2,099,110 | A | * | 11/1937 | Green | 2/237 |
| 2,497,180 | A | * | 2/1950 | Mendelson | 2/231 |
| 3,089,149 | A | * | 5/1963 | Kelleam | 2/221 |
| 3,127,896 | A | * | 4/1964 | Puliafico | 450/95 |
| 3,751,731 | A | | 8/1973 | Bennett | |
| 4,069,513 | A | | 1/1978 | Shiller et al. | |
| 4,400,832 | A | * | 8/1983 | Kinder | 2/406 |
| 4,494,250 | A | * | 1/1985 | Sheppard et al. | 2/227 |
| 4,523,337 | A | * | 6/1985 | Leibowitz | 2/237 |
| 5,092,318 | A | * | 3/1992 | More et al. | 602/27 |
| 5,888,118 | A | * | 3/1999 | Kishi | 450/122 |
| 6,035,448 | A | * | 3/2000 | Thomson | 2/227 |

(Continued)

FOREIGN PATENT DOCUMENTS

| | | |
|---|---|---|
| GB | 2 356 552 | 5/2001 |
| JP | 2001-89916 | 4/2001 |
| WO | 2011/068970 | 6/2011 |

OTHER PUBLICATIONS

Jennifer D'Souza; Search Report issued in related European Application No. 11165865.4; Mar. 30, 2012; 5 pages; European Patent Office.

(Continued)

*Primary Examiner* — Khoa Huynh
*Assistant Examiner* — Andrew W Collins
(74) *Attorney, Agent, or Firm* — Wood, Herron & Evans, LLP

(57) ABSTRACT

A pair of trousers has two side seams, a front seam, a back seam, an inseam, an outer part, and an inner part. The outer part constitutes the trousers and is formed by sub-parts joined at the seams. The inner part is arranged along a front part of the outer part and is joined to the outer part at the side and front seams. The outer part is made from a first material and the inner part is made from a second material, the first material having a higher elasticity than the second material. The inner part includes at least two stitchings extending from a first side seam towards the front seam, and at least two stitchings extending from a second side seam towards the front seam which follow the shape of an abdomen of a person wearing the trousers to thereby support the abdomen.

8 Claims, 6 Drawing Sheets

(56) References Cited

U.S. PATENT DOCUMENTS

| | | | | |
|---|---|---|---|---|
| 6,205,591 | B1 * | 3/2001 | Wheeler et al. | 2/227 |
| 6,311,333 | B1 * | 11/2001 | Batra | 2/237 |
| 6,367,086 | B1 * | 4/2002 | Woodard | 2/237 |
| 6,543,062 | B1 * | 4/2003 | Amsel et al. | 2/227 |
| 7,341,500 | B2 * | 3/2008 | Horn et al. | 450/95 |
| D588,782 | S | 3/2009 | Rudes | |
| RE43,531 | E * | 7/2012 | Hendrickson et al. | 2/227 |
| 2005/0132474 | A1 * | 6/2005 | Amsel et al. | 2/227 |
| 2008/0271226 | A1 | 11/2008 | Ahumada | |
| 2010/0136882 | A1 | 6/2010 | Malish | |
| 2010/0192284 | A1 * | 8/2010 | Simon | 2/236 |
| 2010/0325766 | A1 * | 12/2010 | Mackintosh | 2/22 |
| 2011/0131705 | A1 * | 6/2011 | Waldman et al. | 2/221 |

OTHER PUBLICATIONS

Mette Holm Meyer; Search Report issued in priority Denmark Application No. PA 2010 70310; Feb. 9, 2011; 1 page; Denmark Patent and Trademark Office.

* cited by examiner

PAIR OF TROUSERS

CROSS-REFERENCE TO RELATED APPLICATION

This application claims priority under 35 U.S.C. §119(a) to DK Application No. PA 2010 70310, filed Jul. 1, 2010, the disclosure of which is incorporated by reference herein in its entirety.

TECHNICAL FIELD

The present invention relates to a pair of trousers or pants, such as a pair of jeans, slacks, etc. More particularly, the present invention relates to a pair of trousers in which the appearance of the person wearing the pair of trousers is improved. It should be noted that the pair of trouser of the present invention could have any suitable length, ranging from shorts over knickers and skimpy trousers to full length trousers.

BACKGROUND

It is often desirable for persons to wear garments which make the wearer appear slim. To this end, it has previously been attempted to manufacture garments which support certain parts of the body, such as the abdomen or the buttocks.

U.S. D588,782 S discloses a pair of trousers with stitched pockets. The inside part of each pocket is provided with stitchings crossing each other approximately at the centre of each pocket.

SUMMARY

Embodiments of the invention provide a pair of trousers capable of providing efficient support for an abdominal part of a person wearing the pair of trousers.

Embodiments of the invention further provide a pair of trousers capable of improving the appearance of a person wearing the pair of trousers.

In an exemplary embodiment, a pair of trousers comprises two side seams, a front seam, a back seam and an inseam, the pair of trousers further comprising:

an outer part substantially constituting the pair of trousers, the outer part being formed by sub-parts joined at the side seams, the front seam, the back seam and the inseam, the outer part being made from a first material, an inner part arranged along a front part of the outer part, the inner part being joined to the outer part at the side seams and at the front seam, the inner part being made from a second material, wherein the first material has a significantly higher elasticity than the second material, and wherein the inner part is provided with at least two stitchings extending from a first side seam towards the front seam and at least two stitchings extending from a second side seam towards the front seam, said stitchings extending along substantially straight lines, and in such a manner that the lines of the stitchings do not cross each other.

In the present context the term 'trousers' should be interpreted to cover garments which are supposed to be worn on the lower part of the body with separate leg parts, regardless of the length of the garment. Thus, the term 'trousers' should be interpreted cover jeans, slacks, shorts, knickers, skimpy trousers, full length trousers, etc.

The side seams are arranged along the sides of the trousers. The front seam is arranged at the part of the trousers which is arranged at a front side of a person wearing the trousers. The back seam is arranged at a back side of a person wearing the trousers. The inseam runs from a lower edge of one leg part to a lower edge of the other leg part, via the crotch of the trousers.

The outer part substantially constitutes the pair of trousers in the sense that the outer part is what is visible when a person wears the trousers. The outer part is formed by sub-parts, such as four sub-parts, joined at the side seams, the front seam, the back seam and the inseam, in a usual manner.

The inner part is arranged along a front part of the outer part, i.e., along a part of the outer part where the front seam is arranged. The inner part is arranged inside the trousers in the sense that, when a person wears the trousers, the inner part is arranged between the outer part and the person. Accordingly, the inner part is not visible when a person wears the trousers. The inner part is joined to the outer part at the side seams and at the front seam. Accordingly, the inner part substantially extends along the entire width of the front part, i.e., between the side seams.

The outer part is made from a first material or fabric, and the inner part is made from a second material or fabric. The elasticity of the first material is significantly higher than the elasticity of the second material. In the present context the term 'elasticity' should be interpreted to mean the ability of the material to stretch, i.e., increase its length, along at least one direction, due to a force, such as a strain force, applied to the material, the material being capable of restoring its original size and shape when the force is no longer applied. Thus, a material having a high elasticity is capable of stretching more, due to a given force, than a material having a lower elasticity.

For instance, the first material may be able to obtain an elongation of 20%-30% when a sample of the material is subjected to a pulling force within the interval 3 N to 7 N per cm width of the sample, while the second material may be able to obtain an elongation of less than 1%. In the present context the term 'elongation ' should be interpreted to mean the ratio of the extension of the sample to its initial length when the sample is subjected to a predefined pulling force. The elasticity may advantageously be measured in accordance with the standard BS EN 14704-1, 2005, described in the publication entitled "Determination of the elasticity of fabrics—Part 1: Strip tests".

In one embodiment, the first material comprises elastane, while the second material does not comprise elastane. Since the elastic properties of elastane are very pronounced, a material comprising elastane must be expected to have an elasticity which is significantly higher than a material which does not comprise elastane.

Since the elasticity of the material of the inner part is significantly lower than the elasticity of the outer part, and since the inner part is arranged along the front part of the outer part as described above, the inner part restricts the elasticity of the front part of the outer part, in the sense that the front part of the outer part is only allowed to stretch as much as the inner part allows, even though the material of the outer part would allow the outer part to stretch more under a given force, if the inner part had not been arranged along the front side.

The inner part is provided with at least two stitchings extending from a first side seam towards the front seam and at least two stitchings extending from a second side seam towards the front seam. The stitchings extend along substantially straight lines, and in such a manner that the lines of the stitchings do not cross. This allows the stitchings to be arranged in such a manner that they follow the shape of an abdominal region of a person wearing the trousers, and in such a manner that they substantially cover an area defined by the abdominal region. Thereby, the stitchings provide efficient support for the abdomen, and the combination of the different elasticity properties of the inner part and the outer part and this positioning of the stitchings ensures that the abdomen of a person wearing the trousers is not allowed to expand the front part of the outer part, i.e., the abdomen is supported and 'tucked in'. This makes the person wearing the trousers appear slim.

The number of stitchings extending from each side seam may be exactly two, or it may be three or more, such as between three and seven stitchings, such as between three and five stitchings. The number of stitchings may depend on the size of the trousers, since the larger the size, the more stitchings are expected to be required in order to cover an area defined by the abdomen of a person wearing the trousers.

The stitchings may be arranged with a first distance between neighbouring stitchings at the position of the side seam, and with a second distance between neighbouring stitchings at the position of the front seam, the second distance being larger than the first distance. According to this embodiment, stitchings extending from a given side seam towards the front seam define different slopes with respect to an upper rim, such as a lining, of the trousers, i.e., an angle is defined between neighbouring stitchings. According to this embodiment the shape of an abdomen of a person wearing the trousers is closely followed by the stitchings.

End parts of the stitchings arranged at the side seams may be arranged substantially equidistantly within an interval positioned at a predefined distance from an upper rim of the pair of trousers. The interval may, for example, be defined in such a manner that stitchings arranged closest to the upper rim are arranged at a distance within the interval 5 cm to 10 cm, such as at a distance within the interval 6 cm to 9 cm from the upper rim, and in such a manner that the stitchings arranged furthest away from the upper rim are arranged at a distance within the interval 8 cm to 17 cm, such as at a distance within the interval 9 cm to 16 cm from the upper rim. The exact positioning of the stitchings depends on the size of the trousers. In the case that three or more stitchings are extending from each of the side seams, the remaining stitchings are, according to this embodiment, substantially evenly distributed between the stitchings arranged closest to the upper rim and the stitchings arranged furthest away from the upper rim.

Similarly, end parts of the stitchings arranged at the front seam may be arranged substantially equidistantly within an interval positioned at a predefined distance from the inseam. The interval may, for example, be defined in such a manner that stitchings arranged closest to the upper rim are arranged at a distance within the interval 14 cm to 21 cm, such as at a distance within the interval 15.8 cm to 20.1 cm from the inseam, and in such a manner that the stitchings arranged furthest away from the upper rim are arranged at a distance within the interval 6 cm to 11 cm, such as at a distance within the interval 7.7 cm to 10.6 cm from the inseam. The exact positioning of the stitchings depends on the size of the trousers. For large sizes the area defined by the abdominal region of the person wearing the trousers must be expected to be larger than a corresponding area of a smaller size. Accordingly, for larger sizes the stitchings arranged furthest away from the upper rim must be arranged closer to the inseam than for smaller sizes, in order to ensure that the lowest part of the abdominal region is sufficiently supported by the stitchings. In the case that three or more stitchings are extending from each of the side seams, the remaining stitchings are, according to this embodiment, substantially evenly distributed between the stitchings arranged closest to the upper rim and the stitchings arranged furthest away from the upper rim.

Each of the stitchings may be arranged in such a manner that an end part of the stitching arranged at a side seam is arranged closer to an upper rim of the pair of trouser than an end part of the stitching arranged at the front seam. According to this embodiment, each of the stitchings defines a downward slope from the side seam to the front seam. This ensures that the stitchings follow the shape of the abdomen of the person wearing the pair of trousers even better, thereby providing even better support for the abdomen.

The stitchings may be flat lock stitchings. Flat lock stitchings are very suitable for this purpose, because flat lock stitchings are relatively wide. Thereby, each stitching is capable of providing support for the abdomen of the person wearing the pair of trousers, and visible 'bumps' on the abdomen of the wearer between the stitchings are avoided. Alternatively, any other suitable kind of stitchings providing sufficient support could be used.

The inner part may be at least partly formed by pockets of the trousers. According to this embodiment, the inner part is formed by a part of the trousers which is present for other purposes. Alternatively, and in the case that the trousers do not comprise pockets, the inner part may be formed by an additional piece of fabric with the only purpose of providing support for an abdominal region of a person wearing the trousers.

The pair of trousers may further comprise a fly arranged in the front seam, and the inner part may be formed by two separate parts arranged between the side seams and the fly. Such two separate parts may, for example, be two pockets. As an alternative, the trousers may be of a kind without a fly, for example, of the kind comprising an elastic waist band.

According to one embodiment, the width of the front part of the outer part in a relaxed state may be substantially equal to the width of the inner part in a relaxed state. According to this embodiment, the inner part follows the front part of the outer part closely when the inner part and the front part are in relaxed states, i.e., when the inner part and the front part of the outer part are not subjected to strain forces. This allows the inner part to efficiently limit the elasticity of the front part of the outer part as described above.

Since the outer part and the inner part are made from different materials, the shrinkage of the outer part may defer from the shrinkage of the inner part. Accordingly, the widths of the front part and the inner part, respectively, may advantageously be selected to take this into account. This may, for example, be done by selecting the widths in such a manner that they match after shrinking of the materials.

BRIEF DESCRIPTION OF THE DRAWINGS

The invention will now be described in further detail with reference to the accompanying drawings in which.

DETAILED DESCRIPTION

Figure 1:
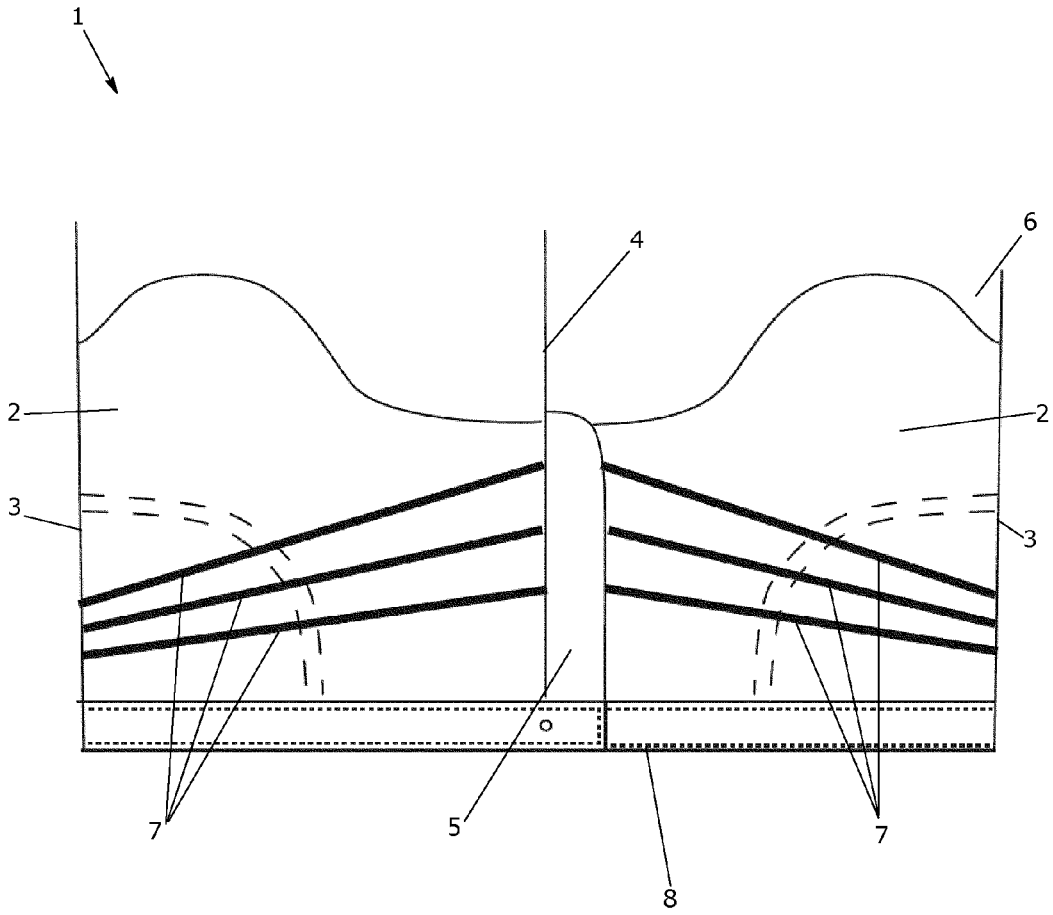
FIG. 1 is a schematic view of a pair of trousers according to a first embodiment of the invention.

FIG. 1 is a schematic view of an upper part of a pair of trousers 1 according to a first embodiment of the invention. A front part of the pair of trousers 1, i.e., the part which is arranged on a front side of a person wearing the trousers 1, is shown. The pair of trouser 1 is shown inside out, i.e., two inner parts 2 in the form of pockets are visible and extending from side seams 3 to a front seam 4. A fly 5 with a zipper (not shown) is arranged at the front seam 4.

An outer part 6 constitutes the part of the trousers 1 which is visible when the trousers 1 are worn by a person.

The outer part 6 is made from a fabric having an elasticity which is significantly higher than the elasticity of the fabric which the inner part 2 is made from. Since the inner parts 2 are arranged along the entire width of the front part of the outer part 6, i.e., between the side seams 3, the inner parts 2 restrict the elasticity or stretchability of the front part of the outer part 6 in the sense that the front part of the outer part 6 is prevented from stretching more than the fabric of the inner parts 2 allows, even though the fabric of the outer part 6 would allow the front part to stretch further if the inner parts 2 had not been arranged along the front part.

Each of the inner parts 2 is provided with three stitchings 7, each extending from a side seam 3 to the fly 5. The stitchings 7 may advantageously be flat lock stitchings. The stitchings 7 are arranged side-by-side, each stitching 7 defining a slope relative to a lining 8 of the pair of trousers 1, and in such a manner that the distance between neighbouring stitchings 7 is larger at the fly 5 than at the side seam 3. Each of the stitchings 7 is arranged closer to the lining 8 at the side seam 3 than at the fly 5. Furthermore, the stitchings 7 arranged on a given inner part 2 do not cross. Thus, the stitchings 7 are arranged in a manner which follows the natural shape of the abdomen of a person wearing the pair of trousers 1, and the stitchings 7, in combination with the elasticity properties of the fabric of the inner parts 2, therefore provide support for the abdomen, thereby 'tucking' the abdomen in and ensuring that the person wearing the trousers 1 appears slimmer.

The distance between neighbouring stitchings 7 is sufficiently small to prevent that parts of the abdomen are allowed to protrude between the stitchings 7. It is also important that the lowest arranged stitchings 7, i.e., the stitchings 7 which are arranged closest to the crotch of the trousers 1, are arranged sufficiently low to be able to support the lowest part of the abdomen of the person wearing the trousers 1. Accordingly, the number of stitchings 7 as well as their arrangement on the inner parts 2 depends on the size of the pair of trousers 1. Thus, the embodiment shown in FIG. 1 is suitable for trousers 1 of approximately European size 36-44.

In the embodiment of FIG. 1, at the side seams 3 the stitchings 7 are arranged in such a manner that the stitchings 7 arranged closest to the lining 8 are arranged at a distance within the interval 5 cm to 8 cm, such as at a distance within the interval 6 cm to 7 cm from the lining 8, depending on the size of the trousers 1. The stitchings 7 arranged furthest away from the lining 8 are arranged at a distance within the interval 8 cm to 14 cm, such as at a distance within the interval 9 cm to 13 cm from the lining 8, depending on the size of the trousers 1. The middle stitchings 7 are arranged approximately half way between the stitchings 7 arranged closest to and furthest away from the lining 8, the stitchings 7 thereby being arranged substantially equidistantly at the side seams 3.

Similarly, at the fly 5 the stitchings 7 are arranged in such a manner that the stitchings 7 arranged closest to the lining 8 are arranged at a distance within the interval 15 cm to 17 cm, such as at a distance within the interval 15.8 cm to 16.1 cm from the inseam (not shown), depending on the size of the trousers 1. The stitchings 7 arranged furthest away from the lining 8 are arranged at a distance within the interval 7 cm to 11 cm, such as at a distance within the interval 8.3 cm to 9.5 cm from the inseam, depending on the size of the trousers 1. The middle stitchings 7 are arranged approximately half way between the stitchings 7 arranged closest to and furthest away from the lining 8, the stitchings 7 thereby being arranged substantially equidistantly at the fly 5.

Figure 2:
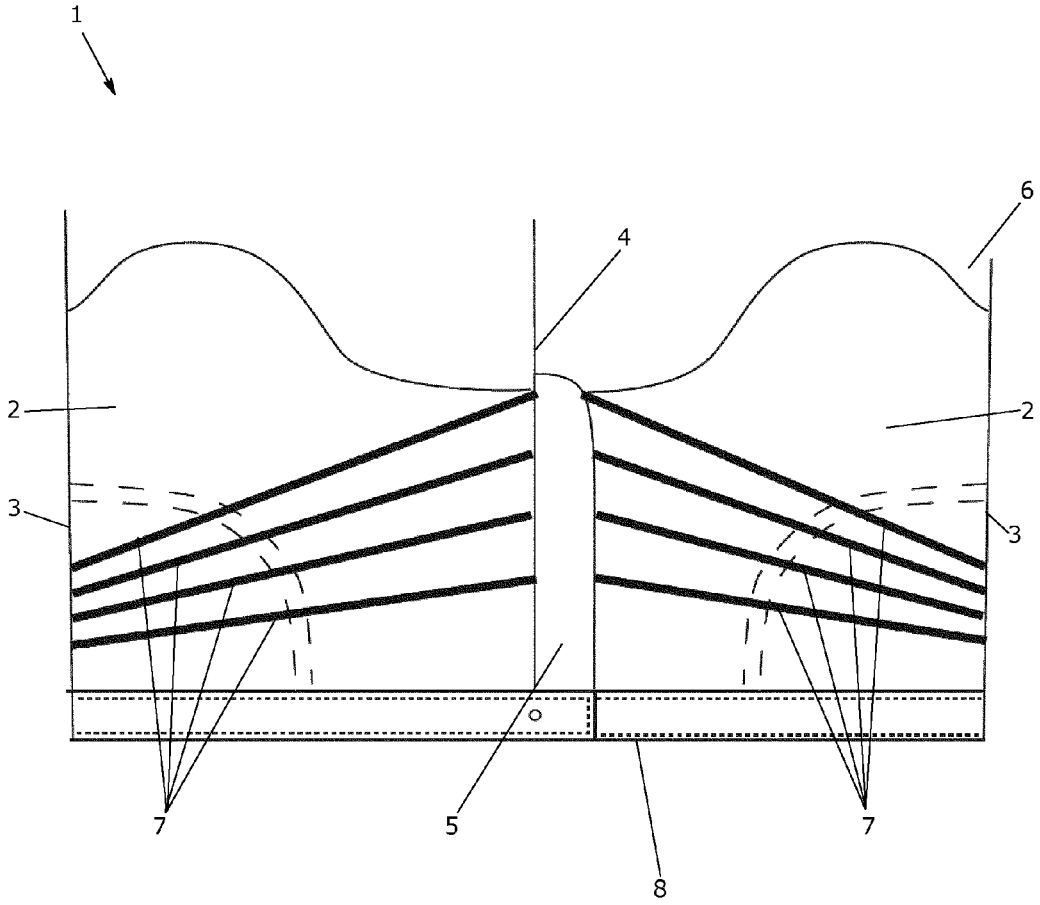
FIG. 2 is a schematic view of a pair of trousers according to a second embodiment of the invention.

FIG. 2 is a schematic view of a pair of trousers 1 according to a second embodiment of the invention. The pair of trousers 1 shown in FIG. 2 is very similar to the pair of trousers shown in FIG. 1, and it will therefore not be described in further detail here. However, in FIG. 2, each of the inner parts 2 is provided with four stitchings 7. This makes the embodiment shown in FIG. 2 suitable for larger sizes than the embodiment shown in FIG. 1. Thus, the embodiment shown in FIG. 2 is suitable for trousers 1 of approximately European size 46-50.

In the embodiment of FIG. 2, at the side seams 3 the stitchings 7 are arranged in such a manner that the stitchings 7 arranged closest to the lining 8 are arranged at a distance within the interval 6 cm to 9 cm, such as at a distance within the interval 7 cm to 8 cm from the lining 8, depending on the size of the trousers 1. The stitchings 7 arranged furthest away from the lining 8 are arranged at a distance within the interval 13 cm to 15 cm, such as at a distance within the interval 13.5 cm to 14.5 cm from the lining 8, depending on the size of the trousers 1. The remaining stitchings 7 are substantially evenly distributed between the stitchings 7 arranged closest to and furthest away from the lining 8, the stitchings 7 thereby being arranged substantially equidistantly at the side seams 3.

Similarly, at the fly 5 the stitchings 7 are arranged in such a manner that the stitchings 7 arranged closest to the lining 8 are arranged at a distance within the interval 15 cm to 19 cm, such as at a distance within the interval 16.2 cm to 17.7 cm from the inseam (not shown), depending on the size of the trousers 1. The stitchings 7 arranged furthest away from the lining 8 are arranged at a distance within the interval 7 cm to 10 cm, such as at a distance within the interval 7.7 cm to 9.2 cm from the inseam, depending on the size of the trousers 1. The remaining stitchings 7 are substantially evenly distributed between the stitchings 7 arranged closest to and furthest away from the lining 8, the stitchings 7 thereby being arranged substantially equidistantly at the fly 5.

Figure 3:
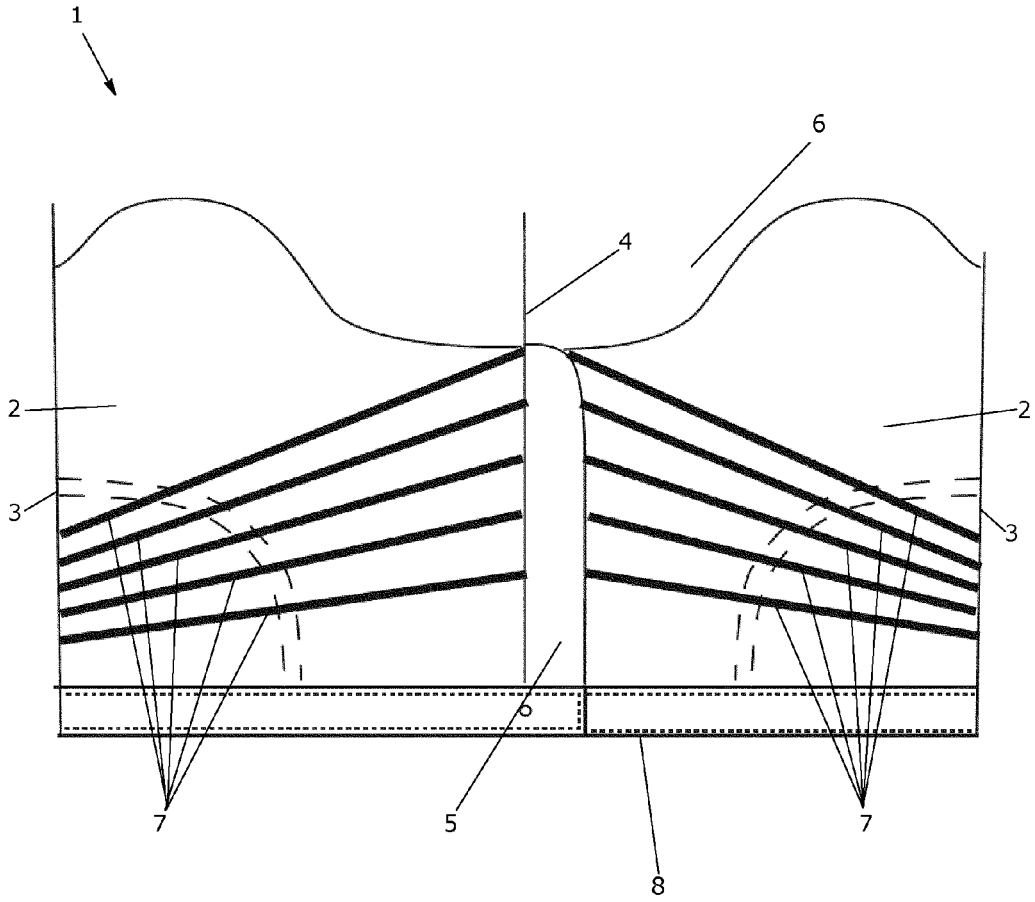
FIG. 3 is a schematic view of a pair of trousers according to a third embodiment of the invention.

FIG. 3 is a schematic view of a pair of trousers 1 according to a third embodiment of the invention. The pair of trousers 1 shown in FIG. 3 is very similar to the pair of trousers shown in FIGS. 1 and 2, and it will therefore not be described in further detail here. However, in FIG. 3, each of the inner parts 2 is provided with five stitchings 7. This makes the embodiment shown in FIG. 3 suitable for even larger sizes than the embodiments shown in FIGS. 1 and 2. Thus, the embodiment shown in FIG. 3 is suitable for trousers 1 of approximately European size 52-60.

In the embodiment of FIG. 3, at the side seams 3 the stitchings 7 are arranged in such a manner that the stitchings 7 arranged closest to the lining 8 are arranged at a distance within the interval 8 cm to 10 cm, such as at a distance within the interval 8.5 cm to 9.5 cm from the lining 8, depending on the size of the trousers 1. The stitchings 7 arranged furthest away from the lining 8 are arranged at a distance within the interval 15 cm to 17 cm, such as at a distance within the interval 15.5 cm to 16.5 cm from the lining 8, depending on the size of the trousers 1. The remaining stitchings 7 are substantially evenly distributed between the stitchings 7 arranged closest to and furthest away from the lining 8, the stitchings 7 thereby being arranged substantially equidistantly at the side seams 3.

Similarly, at the fly 5 the stitchings 7 are arranged in such a manner that the stitchings 7 arranged closest to the lining 8 are arranged at a distance within the interval 17 cm to 21 cm, such as at a distance within the interval 18.2 cm to 20.1 cm from the inseam (not shown), depending on the size of the trousers 1. The stitchings 7 arranged furthest away from the lining 8 are arranged at a distance within the interval 8 cm to 11 cm, such as at a distance within the interval 8.7 cm to 10.6 cm from the inseam, depending on the size of the trousers 1. The remaining stitchings 7 are substantially evenly distributed between the stitchings 7 arranged closest to and furthest away from the lining 8, the stitchings 7 thereby being arranged substantially equidistantly at the fly 5.

It should be noted that even though FIGS. 1-3 show trousers 1 with three, four and five stitchings 7 on each inner part 2, it is not ruled out that a pair of trousers 1 according to the present invention comprises fewer or more stitchings 7 on each inner part 2, such as two stitchings 7, six stitchings 7, seven stitchings 7, etc.

Figure 4:
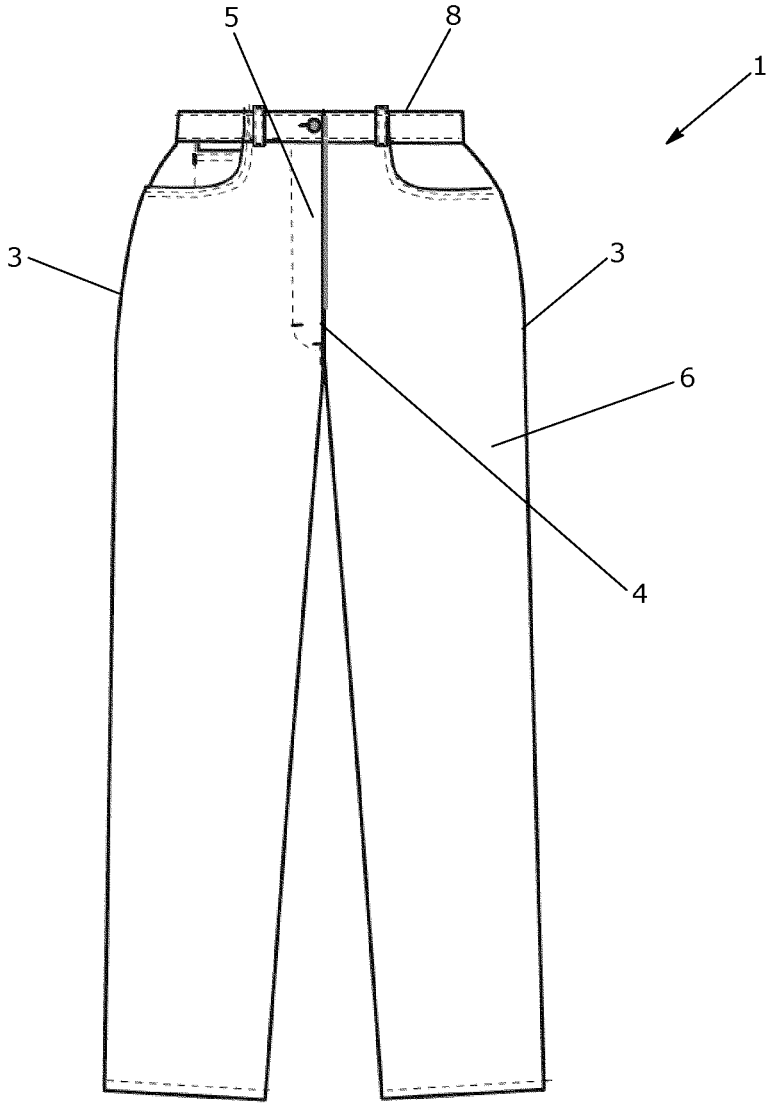
FIGS. 4 and 5 show a pair of trousers according to an embodiment of the invention.
Figure 5:
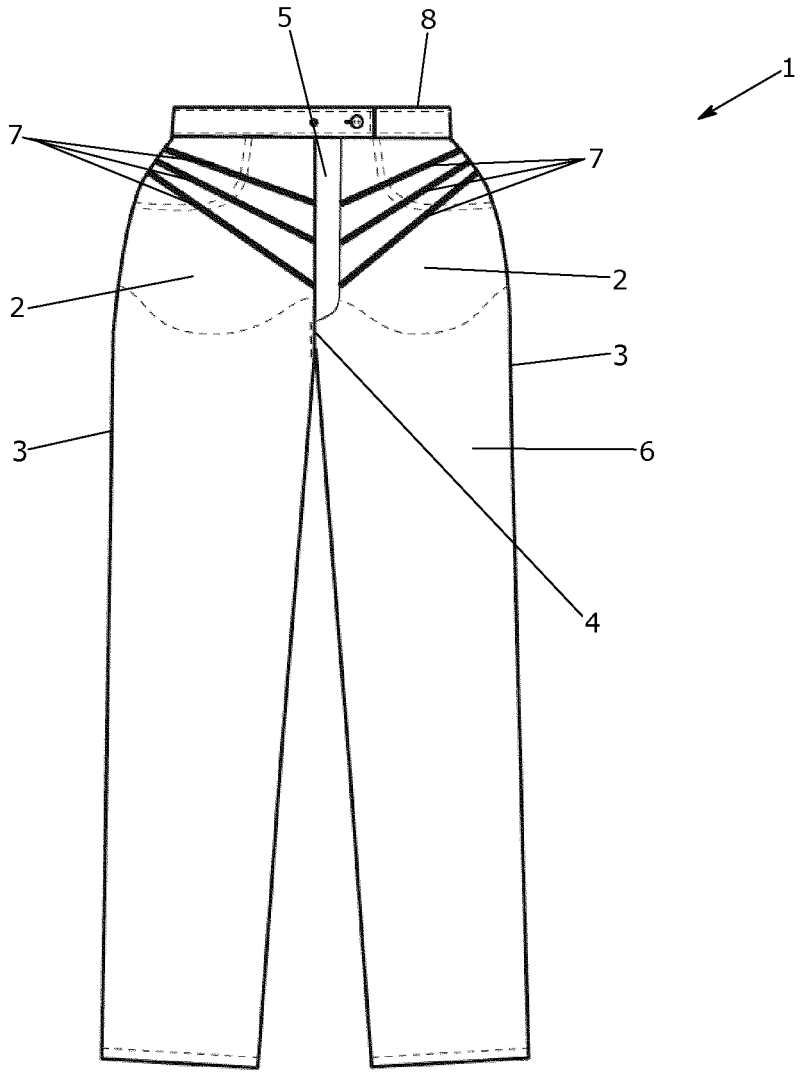

FIGS. 4 and 5 show a pair of trousers 1 according to an embodiment of the invention. In FIG. 4, the pair of trousers 1 is shown with the outer part 6 facing outwards, i.e., in the manner they are normally worn. In FIG. 5 the pair of trousers 1 is shown inside-out, i.e., with the inner parts 2 facing outwards. This allows stitchings 7 on the inner parts 2 to be seen. Each inner part 2 is provided with three stitchings 7, and the embodiment shown in FIGS. 4 and 5 is therefore similar to the first embodiment illustrated in FIG. 1. The remarks set forth above are therefore equally applicable here.

The pair of trousers 1 shown in FIGS. 4 and 5 is a full length pair of trousers 1.

Figure 6:
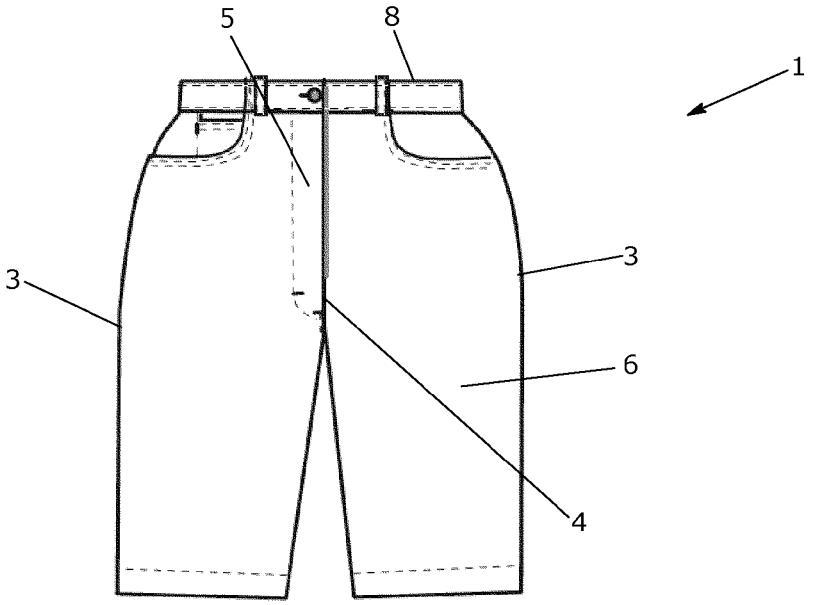
FIGS. 6 and 7 show a pair of trousers according to an alternative embodiment of the invention.
Figure 7:
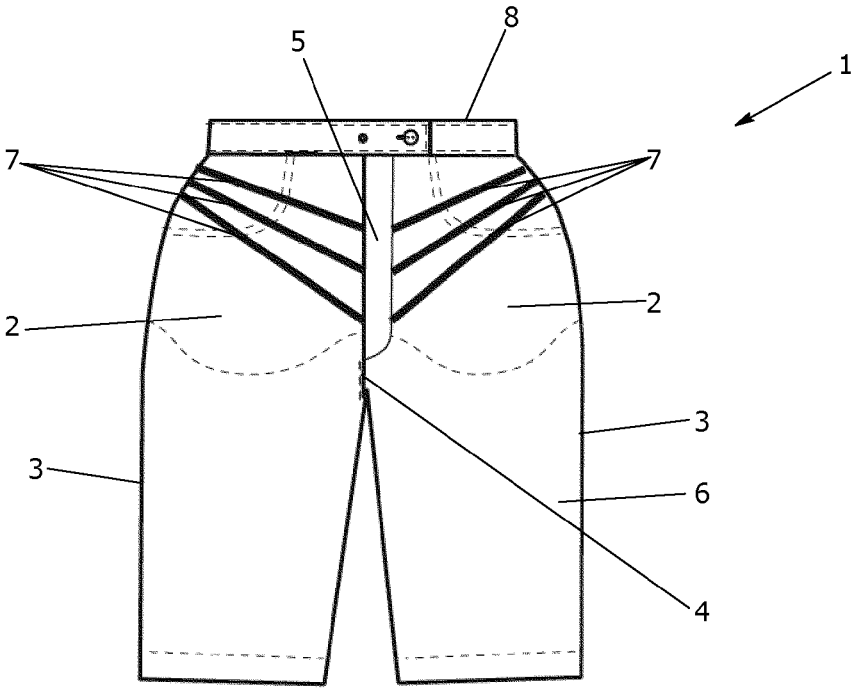

FIGS. 6 and 7 show a pair of trousers 1 according to an alternative embodiment of the invention. In FIG. 6, the pair of trousers 1 is shown with the outer part 6 facing outwards, i.e., in the manner they are normally worn. In FIG. 7 the pair of trousers 1 is shown inside-out, i.e., with the inner parts 2 facing outwards. This allows stitchings 7 on the inner parts 2 to be seen. Each inner part 2 is provided with three stitchings 7, and the embodiment shown in FIGS. 6 and 7 is therefore similar to the first embodiment illustrated in FIG. 1. The remarks set forth above are therefore equally applicable here.

The pair of trousers 1 shown in FIGS. 6 and 7 is a pair of shorts, i.e. the length of the pair of trousers 1 shown in FIGS. 6 and 7 is shorter than the length of the pair of trousers 1 shown in FIGS. 4 and 5.

It should be noted that even though FIGS. 4-7 show trousers 1 having two specific lengths, it is not ruled out that a pair of trousers 1 according to the invention could have a length which differs from the length of the pair of trousers 1 illustrated in FIGS. 4 and 5, and from the length of the pair of trousers 1 illustrated in FIGS. 6 and 7. Thus, aspects of the present invention also cover trousers 1 having a length which is between the length of the pair of trousers 1 of FIGS. 6 and 7 and the length of the pair of trousers 1 of FIGS. 4 and 5. Furthermore, aspects of the present invention cover trousers 1 which are longer than the pair of trousers 1 of FIGS. 4 and 5 and trousers 1 which are shorter than the trousers 1 of FIGS. 6 and 7.

While the invention has been illustrated by a description of the various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative methods, and illustrative examples shown and described. Accordingly, departures may be made from such details without departing from the spirit and scope of the general inventive concept.

What is claimed is:

1. A pair of trousers including two side seams, a front seam, a back seam and an inseam, comprising:

an outer part substantially constituting the pair of trousers, the outer part being formed by sub-parts joined at the side seams, the front seam, the back seam and the inseam, the outer part being made from a first material, an inner part arranged along a front part of the outer part, the inner part being joined to the outer part at the side seams and at the front seam, the inner part being made from a second material, wherein the first material has a significantly higher elasticity than the second material, wherein the inner part is provided with at least two stitchings extending from a first side seam towards the front seam and at least two stitchings extending from a second side seam towards the front seam, said stitchings extending along substantially straight lines, and in such a manner that the lines of the stitchings do not cross each other, and wherein the stitchings are arranged with a first distance between neighbouring stitchings at the position of the side seam, and with a second distance between neighbouring stitchings at the position of the front seam, the second distance being larger than the first distance, the stitchings thereby defining different slopes with respect to an upper rim of the pair of trousers to thereby follow the shape of an abdominal region of a person wearing the pair of trousers.

2. The pair of trousers according to claim 1, wherein end parts of the stitchings arranged at the side seams are arranged substantially equidistantly within an interval positioned at a predefined distance from an upper rim of the pair of trousers.

3. The pair of trousers according to claim 1, wherein end parts of the stitchings arranged at the front seam are arranged substantially equidistantly within an interval positioned at a predefined distance from the inseam.

4. The pair of trousers according to claim 1, wherein each of the stitchings is arranged in such a manner that an end part of the stitching arranged at a side seam is arranged closer to an upper rim of the pair of trouser than an end part of the stitching arranged at the front seam.

5. The pair of trousers according to claim 1, wherein the stitchings are flat lock stitchings.

6. The pair of trousers according to claim 1, wherein the inner part is at least partly formed by pockets of the trousers.

7. The pair of trousers according to claim 1, further comprising a fly arranged in the front seam, and wherein the inner part is formed by two separate parts arranged between the side seams and the fly.

8. The pair of trousers according to claim 1, wherein the width of the front part of the outer part in a relaxed state is substantially equal to the width of the inner part in a relaxed state.

* * * * *